US006121995A

United States Patent [19]

Kattner

[11] Patent Number: 6,121,995

[45] Date of Patent: Sep. 19, 2000

[54] COOLING ARRANGEMENT FOR ELECTRO-OPTICAL CHARACTER GENERATOR

[75] Inventor: Erich Kattner, Neubiberg, Germany

[73] Assignee: Océ Printing Systems GmbH, Poing, Germany

[21] Appl. No.: 09/155,428

[22] PCT Filed: Mar. 26, 1997

[86] PCT No.: PCT/DE97/00641

§ 371 Date: Jul. 6, 1999

§ 102(e) Date: Jul. 6, 1999

[87] PCT Pub. No.: WO97/36212

PCT Pub. Date: Oct. 2, 1997

[30] Foreign Application Priority Data

Mar. 27, 1996 [DE] Germany ..... 196 12 174

[51] Int. Cl.[7] ..... B41J 2/45

[52] U.S. Cl. ..... 347/238; 347/130; 174/15.1; 357/714; 357/716; 372/35

[58] Field of Search ..... 347/238, 242, 347/241, 256, 257, 130; 174/15.1, 16.1; 257/276, 717, 714, 796; 361/699, 701, 703; 372/35, 36; 438/122

[56] References Cited

U.S. PATENT DOCUMENTS 4,875,057 10/1989 Hediger et al. ..... 347/242
4,894,709 1/1990 Phillips et al. ..... 257/714
5,323,292 6/1994 Brzezinski ..... 361/699

FOREIGN PATENT DOCUMENTS 0 575 666 A1 12/1993 European Pat. Off. .
0 629 508 A2 12/1994 European Pat. Off. .
42 21 949 A1 1/1994 Germany .

OTHER PUBLICATIONS

Japanese Abstract, 03221473, Sep. 30, 1991.

Japanese Abstract, 63168372, Dec. 7, 1988.

Japanese Abstract, 07169889, Apr. 7, 1995.

*Primary Examiner*—N. Le
*Assistant Examiner*—Hai C. Pham
*Attorney, Agent, or Firm*—Hill & Simpson

[57] ABSTRACT

A character generator for a printer or copier which illuminates a surface of a photoconductor is provided with a cooling device, wherein a line of LEDs is mounted on a bearing surface of a hollow, thin walled profile that runs along the direction of the LED row. The hollow interior is filled with a liquid. On the other side of the hollow profile from the row of LEDs is a heat dissipating structure, such as a finned heat sink.

9 Claims, 2 Drawing Sheets

COOLING ARRANGEMENT FOR ELECTRO-OPTICAL CHARACTER GENERATOR

BACKGROUND OF THE INVENTION

1. Field of the Invention

The invention relates to an electro-optical character generator for the illumination of the surface of a photoconductor, in particular of a photoconductor in a high-performance printer, having a heat collector on whose bearer surface—facing the photoconductor—there is arranged a multiplicity of light-emitting elements, arranged in a row, for the illumination of the surface of the photoconductor, which are connected in heat-conducting fashion with the heat collector, and in which there is fashioned a hollow space running in the direction of the row, which is filled with a liquid whose quotient of supplied quantity of heat and change of temperature per unit of volume is greater than or equal to 2.5 $kJ/dm^3K$, and having a cooling means connected to the heat collector, for giving off the quantity of heat received by the heat collector to the environment.

2. Description of the Related Art

Electro-optical character generators are used primarily in copier machines and printers. By means of illumination on the surface of a photoconductor, they produce a latent charge image corresponding to the later print image, which image is colored in with toner particles. The colored-in charge image is subsequently transferred to a recording medium using a corona means, and is fixed on the surface thereof in a fixing means. Known character generators have a heat collector that extends in the longitudinal direction of the photoconductor and serves simultaneously as a bearer, on whose one bearing surface, facing the photoconductor, there is arranged a multiplicity of light-emitting elements in a row next to one another, as well as an optical means fastened to the heat collector, which sharply images the light points produced by the light-emitting elements on the surface of the photoconductor.

In addition, the character generator is equipped with a control electronics that drives the individual light-emitting elements independently of one another, by means of a multiplicity of integrated circuits (ICs), in such a way that the quantity of light respectively emitted by the elements is adjustable, and different charge states, and thus different grey gradations or, respectively, color gradations in the later print image, can be realized on the surface of the photoconductor.

As light-emitting elements, light-emitting diodes (called LEDs in the following) are suitable, particularly at an image point density of 600 dpi (dots per inch) and higher, which are fastened in groups of e.g. 128 LEDs on a common chip, known as LED arrays, in a line next to one another. Dependent on the width of the photoconductor, several such LED arrays are fastened next to one another on the bearer surface of the heat collector, the surface running in the longitudinal direction of the photoconductor, and are driven via the control electronics, which if warranted is also connected fixedly with the bearer.

In this LED array, power losses of up to 6 W per LED array can occur, so that in a high-performance printer that has for example a print width of 30 inches and uses approximately 140 such LED arrays for the illumination of the surface of the photoconductor, power losses of approximately 850 W occur. The heat quantity that arises in this way has to be removed, because the surface temperature of each LED may not exceed 50° C. during operation. This is because if the surface temperature of the LED is higher, the quantity of light produced by the LEDs decreases, so that the surface of the photoconductor can no longer be illuminated by the LEDs with the same high quality.

For this reason, the light-emitting elements are connected in heat-conducting fashion with the heat collector, which collects the quantity of heat produced by the elements in order to keep the surface temperature of the elements below a critical temperature value, beyond which, as explained above, a high-quality illumination of the photoconductor is no longer possible. By means of a cooling means connected with the heat collector, the quantity of heat stored by the heat collector is given off to the surrounding environment.

It is known to adapt the actual heat capacity of the heat collector, which results from the weight-specific heat capacity of the material multiplied by the mass of the material used, to the quantity of heat produced by the light-emitting elements as lost power in such a way that this quantity of heat can be removed quickly, in order to prevent heat blockages and the resulting overheatings of the light-emitting elements. For this purpose, heat collectors are used that consist of a metal material with a high weight-specific heat capacity, such as aluminum, copper or the like. The level of the actual heat capacity is determined by the mass of the heat collector used.

Drawn or extruded full profiles made of the correspondingly suitable metal materials are used as heat collectors, which have the required mass, and thereby heat capacity, to be able to store the quantities of heat that occur. However, these heat collectors have the disadvantage that, despite the high section modulus of the full profile, due to their high intrinsic weight they bend so strongly that a uniform sharp imaging of the image points produced by the light-emitting elements on the surface of the photoconductor by the optical means is no longer possible. This problem occurs in particular in high-performance printers and copiers with broad photoconductors. The bending of the bearer of a high-performance printer that can print two paper webs with DIN A4 format or letter size format at the same time can amount to approximately 40 or 50 $\mu$m. During the imaging of the image point, whose diameter is approximately 60 $\mu$m, the optical means thereby produces an imaging error of 3 to 5 $\mu$m, so that a sharp setting of the image points over the entire width of the surface of the photoconductor becomes impossible.

In order to increase further the cooling power of the heat collector, it is further known to fashion cooling channels in the heat collector, through which there flows a liquid that removes the heat.

Thus, EP-0 629 508 A2 specifies a character generator with light-emitting elements, on whose lower side a heat collector is fastened. A U-shaped channel is fashioned in the heat collector, which is connected with an external cooling means and forms a cooling circuit therewith, through which water flows as a cooling liquid.

In this known character generator, there is the problem that the heat collector has to be made of a material that is able to store the occurrent quantities of heat until they are transported away by the cooling liquid. The actual heat capacity of the heat collector results from the weight-specific heat capacity of the material multiplied by the mass of the material used. So that the heat collector possesses a sufficiently high heat capacity, it must be fashioned correspondingly heavily. However, this has the disadvantage that, due to its high intrinsic weight, the heat collector bends so strongly that a uniform sharp imaging of the image points produced by the light-emitting elements on the surface of the photoconductor is no longer possible. In addition, there is the problem that the heat collector is non-uniformly cooled by the water flowing through the channel as a cooling liquid. The light-emitting elements arranged near the entry opening of the channel are cooled more strongly by the cold water flowing in than are the light-emitting elements provided at the other end of the heat collector. There thus results a non-uniform temperature distribution over the length of the heat collector, which reduces the print quality of the character generator.

From JP-A 63 168 372, a character generator is known on whose upper side is fastened a transparent covering that protects the light-emitting elements. On the lower side of the character generator there is fastened a heat collector in which a channel system is fashioned. The hollow space formed by the covering with the upper side of the character generator is connected with the channel system in the heat collector. For the cooling of the light-emitting elements, a cooling liquid consisting of water and alcohol flows through the hollow space and the channel system.

SUMMARY OF THE INVENTION

The object of the invention is to provide a character generator of simple construction that ensures a uniform heat distribution over the entire length of the character generator, with a low degree of bending.

This object and others are achieved for an electro-optical character generator of the type named above in that the hollow space in the heat collector is fashioned by a closed thin-walled hollow profile that runs in the direction of the row and is closed at its two ends. Advantageous developments result from the improvements including that the hollow profile is fashioned as a U-profile that has one base on whose upper side—facing the photoconductor—the bearer surface is fashioned, and that has two limbs that are at least approximately equal in length and that protrude from the lower side—facing away from the upper side—of the base, and in that the U-profile is closed via a base plate connecting the limbs with one another, in such a way that the hollow space extending in the direction of the row is fashioned, which hollow space is respectively closed at each of its two open ends by a terminating plate. The invention is further characterized in that a projection, raised from the base and extending in the direction of the row, is formed essentially in the center of the upper side of the base, which projection forms the bearer surface. The base plate may be fashioned in one piece with the limbs of the U-profile. In addition, the base plate may be connected in liquid-tight fashion with the limbs of the U-profile by means of joining, preferably by hard soldering. The liquid within the space has a quotient within a range from 3.0 kJ/dm$^3$K to 4.5 kJ/dm$^3$K. In one embodiment, the liquid is water.

The cooling means is a cooling grid with a bearer plate fastened in heat-conducting fashion to the hollow profile, from whose plate side facing away from the hollow profile there protrude several cooling ribs arranged in parallel with a spacing from one another. Alternately, the cooling means is a cooling grid with a bearer plate fastened in heat-conducting fashion to the hollow profile, from whose plate side facing away from the hollow profile there protrude several cooling ribs arranged in parallel with a spacing from one another. In a further embodiment, the cooling means is a cooling aggregate having a pump and having a heat exchanger, which aggregate forms a cooling circuit with the hollow profile via a supply line and a drain, through which circuit the liquid circulates, in order to give off to the environment, via the heat exchanger, the quantity of heat collected in the hollow profile.

In the invention, the rigidity of the heat collector is determined by the hollow profile, while the level of the heat capacity of the heat collector depends on the liquid. The heat capacity of the heat collector is determined by the volume-specific heat capacity of the liquid, which is defined as the quotient of the supplied quantity of heat in kJ and the change of temperature in K in relation to a volume unit in dm$^3$, and the volume of liquid used.

By means of the selection of suitable liquids, such as glycerine, water, or the like, whose volume-specific heat capacity is greater than or equal to 2.5 kJ/dm$^3$K, the volume of the hollow space filled with the liquid, which space is surrounded by the thin-walled profile, can be minimized. The greater the volume-specific heat capacity of the liquid is, the smaller the volume of the hollow space can be fashioned, so that the constructive volume of the heat collector decreases correspondingly. The rigidity of the heat collector is decisively dependent on the hollow profile, so that the bending of the heat collector can be minimized by optimizing the cross-sectional shape and by a suitable selection of material, whereby imaging errors due to the bending of the heat collector are reduced, and the character generator operates with a higher imaging quality.

The hollow profile preferably has a cross-sectional shape whose geometrical moment of inertia is large enough that the bearer surface can bend only far enough that the light points produced by the light-emitting elements are still sharply imaged on the surface of the photoconductor, i.e. are imaged uniformly over the entire length thereof.

In a preferred embodiment of the character generator, the hollow profile is fashioned as a U-profile that has a base on whose upper side, facing the photoconductor, the bearer surface is fashioned, and that has two limbs that are at least approximately equal in length and that protrude from the lower side—facing away from the upper side—of the base. The limbs are connected with one another via a base plate, so that the U-profile is closed and the hollow space extending in the direction of the row is fashioned. The hollow space is respectively closed at each of its two open ends via a terminating plate. Due to the fashioning of the hollow profile as a U-profile, the heat collector has a high geometrical moment of inertia, by means of which the bending of the electro-optical character generator is minimized.

Preferably, a projection, raised from the base, that forms the bearer surface is formed on the upper side of the base, approximately in the center, and extends in the direction of the row. In this way, corresponding space for the control electronics remains free on both sides of the projection on the upper side of the base, whereby a particularly compact construction of the character generator is possible.

The U-profile can be manufactured by drawing or extrusion, whereby the base plate is fashioned in one piece with the limbs of the U-profile. In a further embodiment, the base plate is connected in liquid-tight fashion with the limbs of the U-profile by means of joining, i.e. by means of manufacturing methods such as welding, soldering or gluing. As a metal material, non-ferrous materials such as aluminum, copper or the like, as well as alloys thereof, are suited. However, conventional constructional steels or alloyed steels can also be used for the hollow profile of the heat collector.

As a liquid for the heat collector, a liquid is proposed whose named quotient lies in a range from 3.0 to 5 kJ/dm$^3$K, preferably in a range from 3.5 to 4.5 kJ/dm$^3$K, since in comparison with their volume-specific heat capacity these liquids have a low density, and the intrinsic weight of the liquid, due to which the heat collector additionally bends, is low. Proposed liquids include glycerin with a volume-specific heat capacity of approximately 3.0 kJ/dm$^3$K, or water with a volume-specific heat capacity of approximately 4.2 kJ/dm$^3$K, because the density of this liquid, compared with the density of suitable metal materials with similarly high volume-specific heat capacities, is however low.

As a cooling means, a cooling grid is proposed that has a bearer plate fastened in heat-conductive fashion to the hollow profile; from the plate side—facing away from the hollow profile—of this bearer plate, several cooling ribs arranged at a spacing from one another protrude in perpendicular fashion.

BRIEF DESCRIPTION OF THE DRAWINGS

In the following, the invention is explained in more detail on the basis of the drawing.

DETAILED DESCRIPTION OF THE PREFERRED EMBODIMENTS

Figure 1:
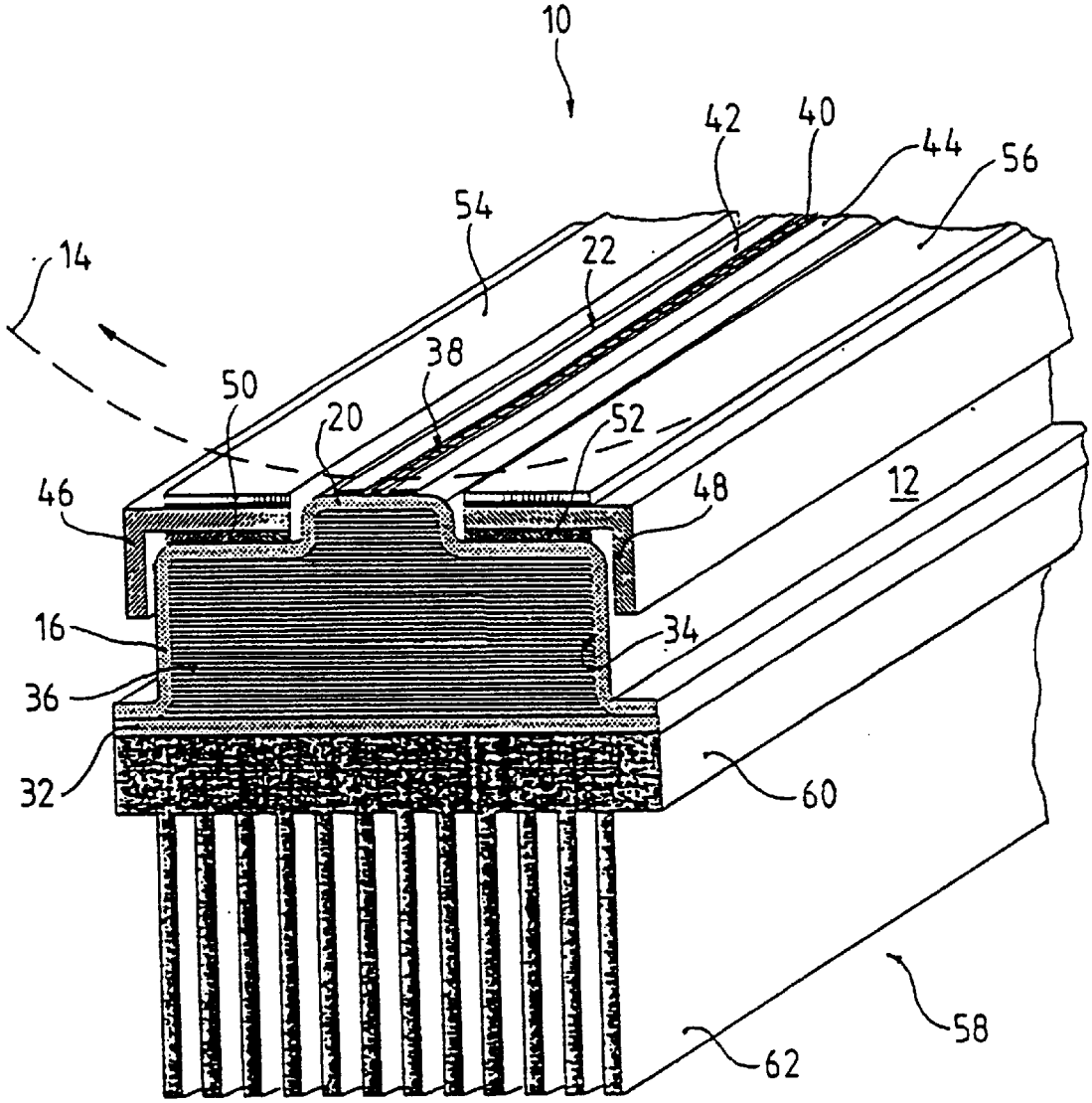
FIG. 1 shows a perspective view of a segment of a character generator.
Figure 2:
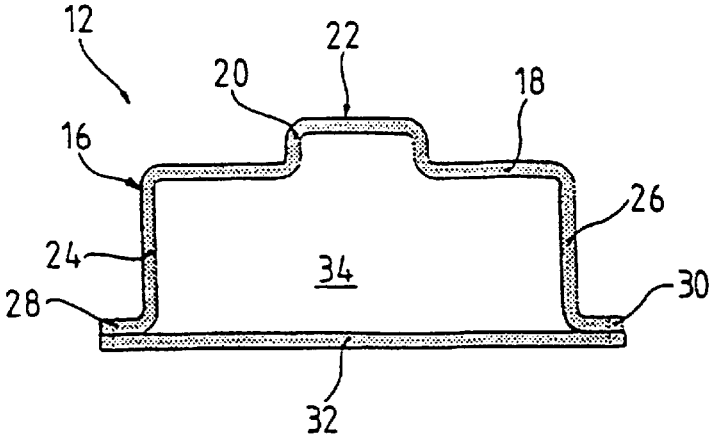
FIG. 2 shows a sectioned front view of a heat collector used in the character generator according to FIG. 1.
Figure 3:
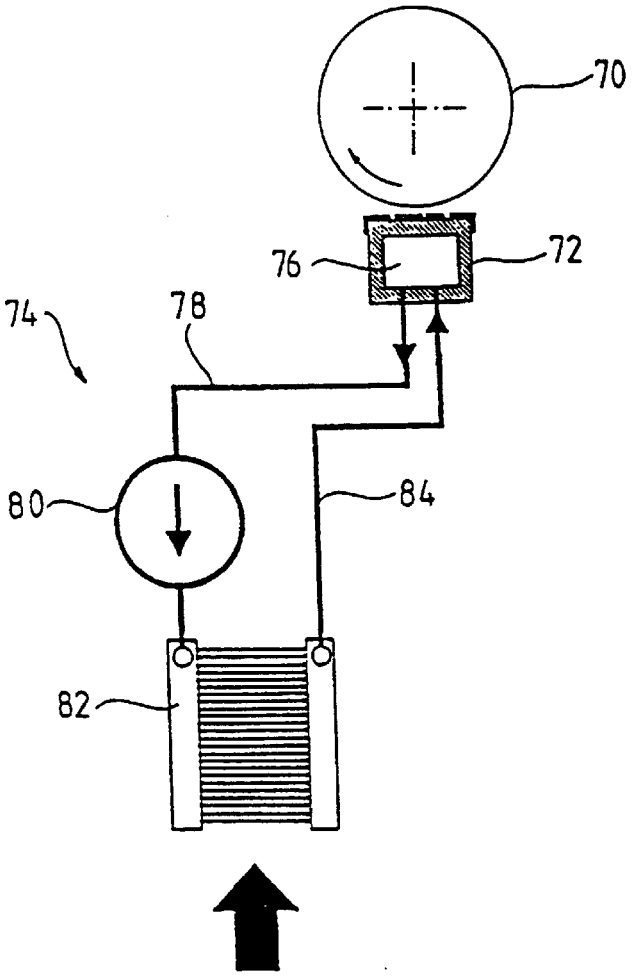

FIG. 1 shows a perspective view of a segment of a character generator 10 used in a high-performance printer. The character generator 10 has a heat collector 12 that serves as a bearer, which extends transverse to the direction of motion of a rotating photoconductor drum 14 (shown in dotted lines) of the printer. As shown in FIG. 2, the heat collector 12, made of copper, is fashioned as a U-profile 16. The U-profile 16 has a base 18 on whose upper side (facing the photoconductor, which is not shown), approximately in the center, a projection 20 raised from the base 18 and extending in the longitudinal direction of the U-profile 16 is formed. The upper side—facing the photoconductor drum 14—of the projection 20 is microfinished, and serves as a bearer surface 22 for light-emitting elements, as is explained below. The longitudinal edges of the base 18 are bent around in such a way that two limbs 24 and 26, approximately equal in length and extending in the longitudinal direction of the U-profile 16, are formed, which stand out approximately perpendicularly from the lower side—facing away from the photoconductor drum 14—of the base 18. The respective free end of each limb 24 and 26 is bent outward at a right angle in such a way that on each limb 24 and 26 a fastening edge 28 or, respectively, 30 is fashioned that extends in the longitudinal direction of the U-profile 16 and runs approximately parallel to the upper side of the base 18. The lower surface—facing away from the photoconductor drum 14—of each fastening edge 28 and 30 is shaped flat, and serves as a support surface for a base plate 32 that connects the two limbs 24 and 26 with one another and extends over the entire length of the U-profile 16. The base plate 32 is hard-soldered in liquid-tight fashion with the fastening edges 28 and 30 of the U-profile 16, so that a hollow space 34 extending in the longitudinal direction of the heat collector 12 is formed that is respectively sealed at its two open ends via a terminal plate (not shown). This hollow space 34 is, as shown in FIG. 1, filled with water 36, which serves as a heat-storing element, as is explained below.

As shown in FIG. 1, in the center of the bearer surface 22 several LED arrays 38 are connected in heat-conducting fashion with the heat collector 12, whereby in this embodiment each LED array 38 bears 128 light-emitting diodes (LEDs) arranged next to one another in a row. The LED arrays 38 are likewise arranged next to one another, so that their LEDs form an LED row 40 extending in the longitudinal direction of the heat collector 12, which row serves for the illumination of the surface of the photoconductor drum 14. Above the LED row 40, there is additionally arranged an optical means that images the emission surfaces of the LEDs on the surface of the photoconductor drum 14, which means is however not shown for reasons of clarity.

On each side of the LED row 40, there is respectively arranged an IC row 42 or, respectively, 44, extending in the longitudinal direction of the heat collector 12 and consisting of several ICs (integrated circuits), which are respectively connected in electrically conductive fashion with the heat collector 12 and drive the individual LEDs of the LED row 40. On both sides of the projection 20, there is respectively arranged a conductor rail 46 or, respectively, 48 that has an L-shaped cross-section and extends in the longitudinal direction of the heat collector 12, which is fixedly connected with the upper side of the U-profile 16 via an insulating layer 50 or, respectively, 52. Approximately at the level of the IC rows 42 and 44, each conductor rail 46 and 48 bears a flat assembly 54 or, respectively, 56, connected in conductive fashion with these rails, on which assemblies interconnects (not shown) are respectively fashioned, which are connected with the individual ICs of the IC rows 42 or, respectively, 44 via Bond connections. On the lower side of the heat collector 12, a cooling grid 58 is in addition fastened. The cooling grid 58 has a bearer plate 60 that extends over the entire width of the base plate 32 and runs over the entire length of the heat collector 12, which bearer plate is connected in heat-conducting fashion with the base plate 32 and from whose plate side—facing away from the base plate 32—several cooling ribs 62, running in the longitudinal direction of the heat collector 12 and arranged in parallel with a spacing from one another, protrude in perpendicular fashion.

As soon as the printer begins print operation, the individual ICs of the IC rows 42 and 44 activate the various LEDs of the LED array 38, whereby the surface of the photoconductor drum 14 is illuminated. Dependent on the control data of the control electronics, the ICs vary the quantity of light given off by the LEDs, so that various charge states can be realized on the surface of the photoconductor drum 14, and various gray or, respectively, colored tones can thus be realized in the later print image. Due to the constant switching on and off of the LEDs of the LED array 38, heat arises that has to be led off via the heat collector 12. For this purpose, the U-profile 16, made of copper, transfers the heat produced by the LEDs to the water 36 located in the hollow space 34, which stores the heat and gradually transfers it to the cooling ribs 62 of the cooling grid 58 via the base plate 32 and the bearer plate 60, the ribs giving the heat off to the environment.

Although other modifications and changes may be suggested by those skilled in the art, it is the intention of the inventors to embody within the patent warranted hereon all changes and modifications as reasonably and properly come within the scope of their contribution to the art.

What is claimed is:

1. Electro-optical character generator for illuminating a surface of a photoconductor, comprising:

a heat collector having a bearer surface facing the photoconductor;

a multiplicity of light-emitting elements arranged in a row for illumination of the surface of the photoconductor, said light-emitting elements being connected in heat-conductive fashion with the heat collector;

said heat collector being fashioned with a hollow space running in a direction of the row;

a liquid filled in said hollow space, said liquid having a quotient of supplied quantity of heat and change of temperature per volume unit greater than or equal to 2.5 $kJ/dm^3K$;

a cooling structure connected with the heat collector for giving off a quantity of heat collected by the heat collector to the environment; and the heat collector which forms the hollow space being fashioned by a closed thin-walled hollow profile running in the direction of the row, said hollow space being closed at two ends of said hollow space, said closed thin-walled hollow profile being of an elongated shape extending in a direction of the row and shaped to resist bending so as to maintain said light emitting elements in respective predetermined printing positions relative to one another.

2. Electro-optical character generator according to claim 1, wherein the hollow profile including a U-profile that has one base, said base having an upper side facing the photoconductor, said upper side having the bearer surface, said U-profile having two limbs that are at least approximately equal in length and that protrude from a lower side facing away from the upper side of the base, and a base plate connecting the limbs with one another to close said U-profile in such a way that the hollow space extending in the direction of the row is fashioned;

a terminating plate mounted as at each end of the hollow space to close the hollow space.

3. Electro-optical character generator according to claim 2, further comprising:

a projection raised from the base and extending in the direction of the row, said projection being formed essentially in a center of an upper side of the base, said projection forming the bearer surface.

4. Electro-optical character generator according to claim 2, wherein the base plate is fashioned in one piece with the limbs of the U-profile.

5. Electro-optical character generator according to claim 2, wherein the base plate is connected in liquid-tight fashion with the limbs of the U-profile by joining.

6. Electro-optical character generator according to claim 1, wherein said liquid has a quotient which lies within a range from 3.0 $kJ/dm^3K$ to 4.5 $kJ/dm^3K$.

7. Electro-optical character generator according to claim 1, wherein the liquid is water.

8. Electro-optical character generator according to claim 1, wherein said cooling structure is a cooling grid with a bearer plate fastened in heat-conducting fashion to the hollow profile, said cooling structure having a plate side facing away from the hollow profile and several cooling ribs protruding from said plate side arranged in parallel with a spacing from one another.

9. Electro-optical character generator according to claim 1, wherein said cooling structure is a cooling aggregate having a pump and having a heat exchanger, said aggregate forming a cooling circuit with the hollow profile via a supply line and a drain, the liquid circulates to give off to the environment via the heat exchanger heat collected in the hollow profile.

* * * * *